United States Patent [19]

Tabicman et al.

[11] 4,167,266

[45] Sep. 11, 1979

[54] INDOOR GOLF DRIVING RANGE

[76] Inventors: Benjamin Tabicman, 630 Rugsley Ave., Bronx, N.Y. 10473; Howard Rapp, 70 Ash St., Englewood Cliffs, N.J. 07632

[21] Appl. No.: 813,832

[22] Filed: Jul. 8, 1977

[51] Int. Cl.[2] ..... A63B 69/36

[52] U.S. Cl. ..... 273/35 B; 273/176 A; 273/182 R; 273/184 R

[58] Field of Search ..... 273/182 A, 182 R, 176 A, 273/181 E, 35 B, 184 R, 176 F, 176 FA, 32 R, 185 R, 185 A, 185 B

[56] References Cited

U.S. PATENT DOCUMENTS 3,687,457 8/1972 Mason et al. ..... 273/182 A X 3,897,947 8/1975 Heffley ..... 273/176 A X

FOREIGN PATENT DOCUMENTS 325441 2/1930 United Kingdom ..... 273/182 R

*Primary Examiner*—George J. Marlo

*Attorney, Agent, or Firm*—Dayton R. Stemple, Jr.

[57] ABSTRACT

An indoor golf driving range within a pressurized tent cover having a target backstop in the center with a driving range on each side with a system for collecting and returning balls to a specific point for reuse. The target is positioned and marked to show if the ball hitting the target has the proper loft with the particular hitting club used. The target backstop may be electrically wired to indicate by lights where it is contacted by a driven golf ball.

6 Claims, 4 Drawing Figures

INDOOR GOLF DRIVING RANGE

BACKGROUND OF INVENTION

This invention relates to new and useful improvements in indoor golf driving ranges and more particularly seeks to provide a driving range with ball return using a backstop that is positioned and marked to determine when hit by a driven ball whether the ball was correctly stroked according to the selected club.

Golf driving ranges are commonly located outside because the distance needed for the longest driving wood is up to 300 yards, which would be very expensive to cover. However, much enjoyment and practice can be accomplished at a driving range without the facilities of a full golf course.

Tennis courts are quite often indoors, e.g., covered by an air-supported tent because the space requirement for tennis is much less than for golf driving ranges.

It is desirable to know without benefit of a third party or expensive golf pro whether the ball has been correctly hit, particularly when using a driving range for practice purposes.

OBJECTS OF INVENTION

It is an object of this invention to provide a short, driving range with a backstop, all being under cover.

It is a further object to optionally have a common backstop to which dual ranges are directed from either side.

It is another object to have the backstop positioned and marked whereby noting where the driven ball strikes same will indicate whether the ball was properly hit with the particular club selected by the player, thereby permitting the player to adjust his swing or change his club to secure proper results.

It is also an object to provide automatic indication of where the ball hits as well as automatic collection and return of the balls to the player's driving area or to the manager for reuse or resale.

SUMMARY OF INVENTION

A backstop extends from the floor to ceiling in a building with a driving range on at least one side extending to the tees or driving areas. The backstop is appropriately marked to show where a ball should strike if properly lofted by the selected club. In addition, the floor surface is arranged for the balls to be automatically returned to a point where an operator or the driver can regain the balls. For space economy, the backstop may be centered in the building with a driving range on both sides extending toward the ends of the building.

With these and other objects, the nature of which are apparent, the invention will be more fully understood by reference to the drawings, the accompanying detailed description, and the appended claims.

DETAILS OF THE INVENTION

In the Drawings

Figure 1:
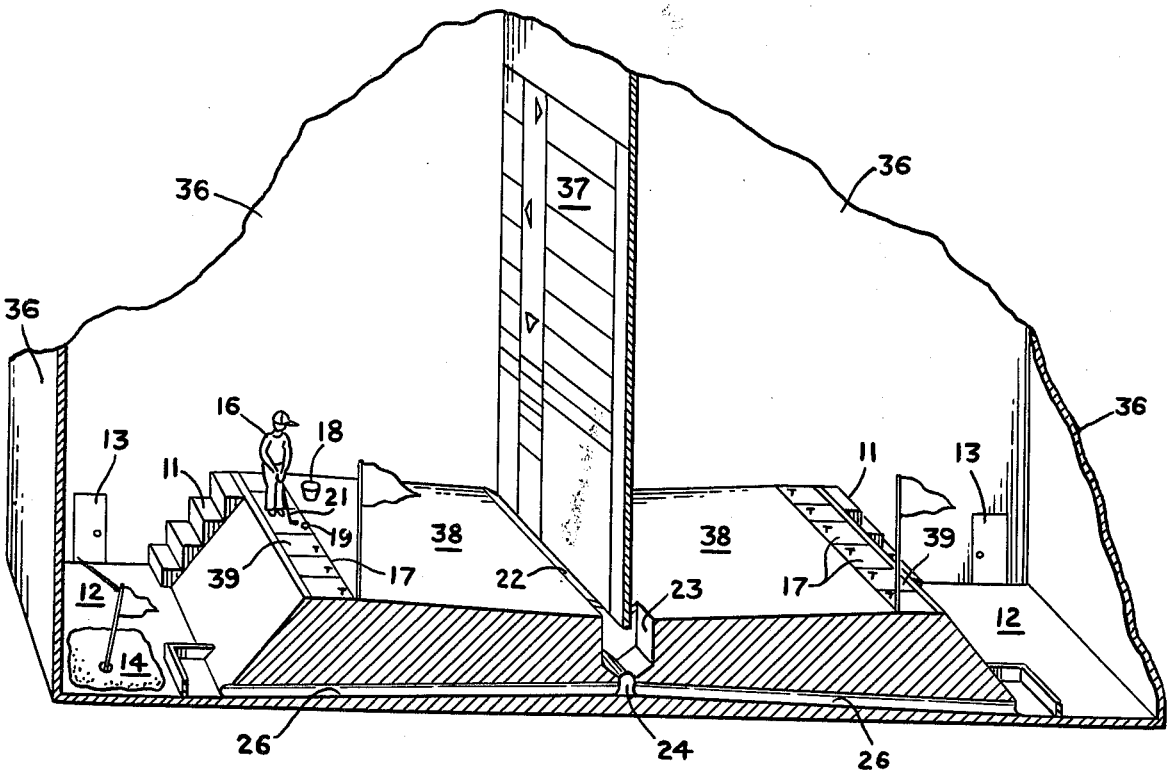
FIG. 1 is a perspective view of an indoor double-driving range constructed in accordance with this invention.
Figure 2:
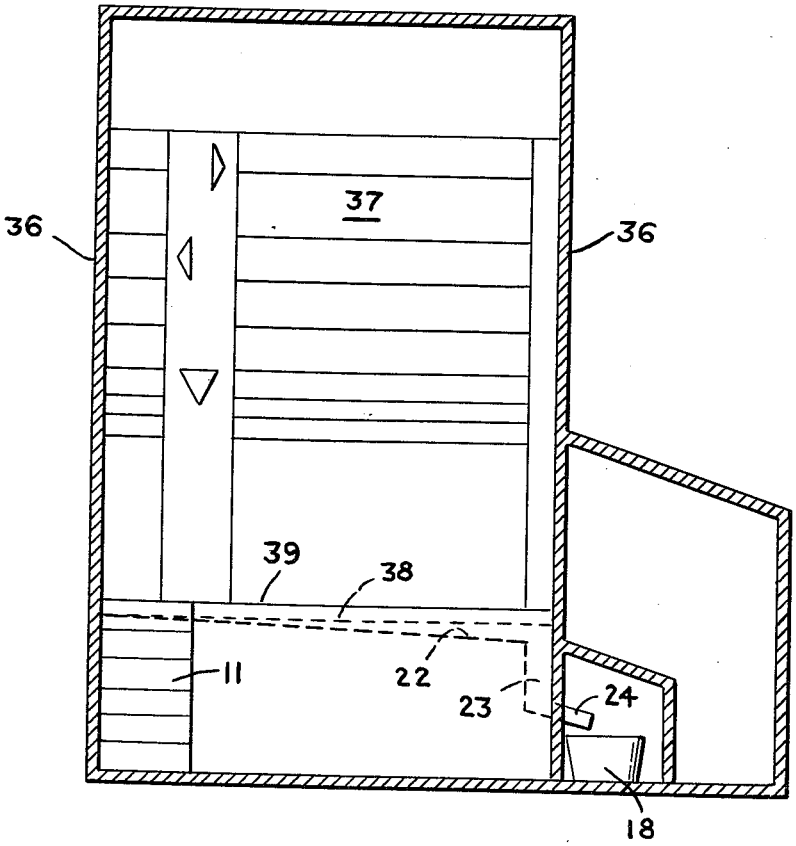
FIG. 2 is an end view taken from the left end of FIG. 1.

As illustrated, there is shown in FIG. 1 an inflated building 36 divided into halves by a backstop 37 with each half having a long surface 38 sloping toward the backstop, a tee area 39, steps 11 and entrance area 12.

The player enters the entrance area 12 through door 13 and may stay in this area for drinks, food or other waiting activity prior to or after driving golf balls. Moreover, a putting green 14 may be provided in this area. When desired, the player 16 may mount steps 11 to the individual tee 17 in tee area 39 to be provided with a bucket 18 of golf balls 19.

The player having chosen any given club 21 drives the ball toward and against the backstop 37. The balls generally drop into channels 22, or if the ball falls on sloping surface 38, they roll into channel 22 and thence along the sloped channels 22 into pit 23 which is provided with a slot 24 at the bottom under which a bucket 18 may be set to collect balls.

Although bucket 18 and slot 24 are shown outside of the exterior wall of building 36, the slot may be reversed so that everything is within the building 36 with a small door for the operator to reach the bucket.

In the alternative, a channel 26 may run from slot 24 back to each entrance area. Either channel 26 may be blocked at slot 24 so that the balls at any given time run to one entrance area only. In addition to gravity returning the golf balls, mechanical means may be utilized to collect and return balls.

Figure 3:
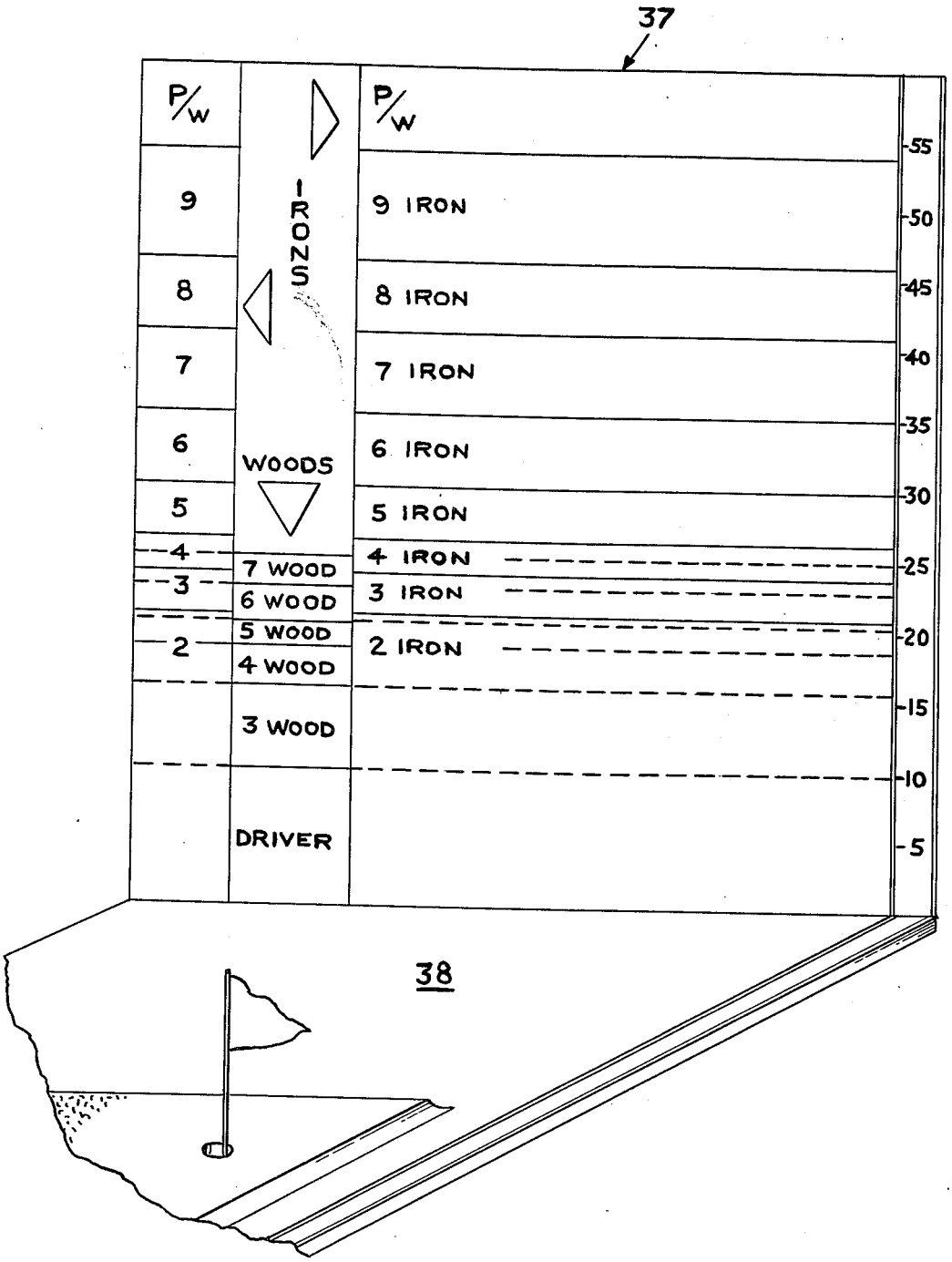
FIG. 3 is a detailed view of one side of the backstop.

FIG. 3 shows the detailed design of the backdrop 37 with the areas where a properly hit ball will strike from the appropriate club with irons being shown on the left, woods at left center, irons again to the right of the woods and the actual height in feet at the right margin of the backstop. The different areas may be further distinguished by different colors. In addition, an electrical system may be installed to the backstop to make contact and light appropriate lights for the given area when hit by a ball.

Figure 4:
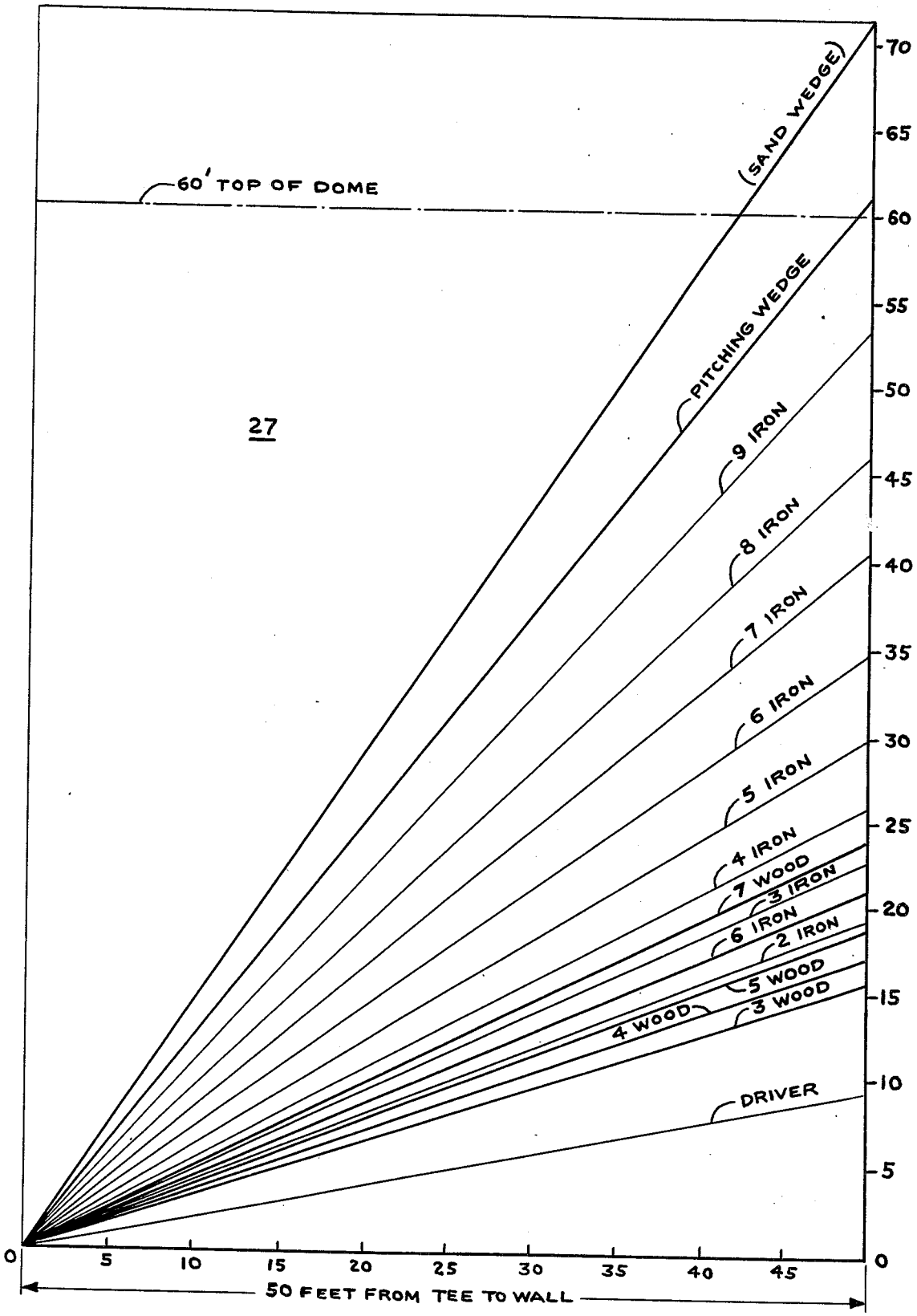
FIG. 4 is a diagrammatic chart showing the height at which a golf ball should strike the backstop at given distances from the tee for various clubs if properly hit by the player.

The chart 27 shown in FIG. 4 can be used to determine the spacing of the backstop from the tee and the level at which to put the various club levels for a given space. The driving face of clubs have a standardized lofting surface which determines the lift according to the following table:

| Club | Loft | Average Distance |
|---|---|---|
| Wood | 10°–12° | 220 yards |
| 3 Wood | 16°–18° | 210 yards |
| 4 Wood | 19°–21° | 200 yards |
| 5 Wood | 22°–24° | 190 yards |
| 2 Iron | 20° | 180 yards |
| 3 Iron | 23° | 170 yards |
| 4 Iron | 27° | 160 yards |
| 5 Iron | 31° | 150 yards |
| 6 Iron | 35° | 140 yards |
| 7 Iron | 39° | 130 yards |
| 8 Iron | 42° | 120 yards |
| 9 Iron | 47° | 110 yards |
| Pitching Wedge | 54° | 90 yards |
| Sand Wedge | 58V | 70 yards |

We claim:

1. An indoor golf driving course comprising a flexible building maintained in erected condition by air pressure retained therein, a backstop extended from the floor to ceiling and positioned toward the center of said building, a driving range extending from each side of said backstop toward the corresponding end of said building, a tee area located near each said corresponding end; said backstop being marked on both sides in accordance with the distance from said tee area to show correct loft of a golf ball hit by a given club at said tee area; and means to return to a given point said balls that were driven from said tee area toward said backstop.

2. The course of claim 1 wherein the surface from said tee area slopes downwardly toward said backstop, and a channel is provided at the bottom of said backstop that slopes toward and terminating in a pit at one end of said backstop at said given point.

3. The course of claim 2 wherein said pit is adapted to receive a container for golf balls flowing therein from said channel.

4. The course of claim 2 wherein a second channel slopes downwardly from said pit and extends back toward the corresponding end of said building.

5. The course of claim 4 wherein said backstop is electrically wired to indicate by lights where said backstop is contacted by a driven golf ball.

6. An indoor golf driving course comprising a backstop within a building, a driving range extending from said backstop toward one end of said building, a tee area located near said one end; said backstop being marked in accordance with the distance from said tee area to show correct loft of a golf ball hit by a given club at said tee area and being electrically wired to indicate by lights where said backstop is contacted by a driven golf ball; and means to return said balls to a given point that were driven from said tee area toward said backstop.

* * * * *